United States Patent [19]

Naku

[11] Patent Number: 4,991,751

[45] Date of Patent: Feb. 12, 1991

[54] FOAM ACTUATOR FOR METERING AN AEROSOL PRODUCT

[75] Inventor: Virgil Naku, Hawthorne, N.Y.

[73] Assignee: Precision Valve Corporation, Yonkers, N.Y.

[21] Appl. No.: 453,396

[22] Filed: Dec. 19, 1989

[51] Int. Cl.[5] ..... B65D 83/20

[52] U.S. Cl. ..... 222/402.13; 222/402.2

[58] Field of Search ..... 222/402.2, 402.13, 402.1

[56] References Cited

U.S. PATENT DOCUMENTS

| | | | |
|---|---|---|---|
| 2,989,217 | 6/1961 | Focht | 222/402.2 |
| 3,385,482 | 5/1968 | Frangos | 222/402.2 |
| 3,991,916 | 11/1976 | Del Bon | 222/402.13 |

*Primary Examiner*—Andres Kashnikow
*Assistant Examiner*—Anthoula Pomrening
*Attorney, Agent, or Firm*—Davis Hoxie Faithfull & Hapgood

[57] ABSTRACT

A metering actuator for dispensing the pressurized contents of an aerosol container through a tubular valve stem associated therewith, the actuator having a valve-opening member to receive the valve stem and conduct the contents of the container to a metering chamber formed between the valve-opening member and a surrounding finger-bearing member, which finger-bearing member has a conduit connecting the metering chamber and a discharge orifice; wherein a seal is effected between a dome shaped portion of the valve-opening member and a hub on the finger-bearing member to close off the conduit from the metering chamber to the discharge orifice, and wherein, there is a seal effected between a mating annual wall and recess disposed on the outer portions of the finger-bearing and valve-opening members.

4 Claims, 2 Drawing Sheets

FOAM ACTUATOR FOR METERING AN AEROSOL PRODUCT

This invention relates to an actuator for metering a foam product from an aerosol container.

BACKGROUND

Aerosol dispensers generally embody a container for a liquid "active ingredient", maintained under pressure in the container by a "propellant" and adapted to be autogeneously discharged therefrom through a manually operable valve when the latter is opened to pass an aerosol mixture of material through a tubular valve stem to a valve operating push button from which it is discharged to the atmosphere. The great majority of aerosol dispensers deliver the aerosol material to the atmosphere as long as the valve is held open and the pressure within the container is sufficient to discharge the material therefrom.

Aerosol dispensers have heretofore been constructed to deliver from the container measured quantities of the material at each operation of the actuator. Many of said prior dispensers comprise metering devices built into the container itself and usually forming an inherent portion of the valve, while others are so constituted that the metering function is carried out in the valve operating actuator. This invention is directed to the latter type and its object is to provide a more satisfactory and efficient metering actuator than those which have gone before.

An actuator of the metering type is shown in the U.S. Pat. No. 2,989,217. The actuator of the U.S. Pat. No. 2,989,217 patent has finger-bearing and valve-opening members. The subject invention concerns an improvement in the actuator of the type shown in the above-identified patent. In particular, the subject invention concerns an improvement in the seal at several essential interfaces of the finger-bearing member and the valve opening member of the actuator.

SUMMARY OF THE INVENTION

The actuator of the subject invention has two components. One component is frictionally engaged with the valve stem that extends through a top opening of the valve-bearing closure of a conventional aerosol container; said component referred to hereinafter as the valve-opening member. A second component (referred to herein as a finger-bearing member) having a metering chamber, defined in part by the outer surface of the valve-opening member, and a conduit terminating in a discharge nozzle communicating therewith surrounds and fits onto the base of the said finger-bearing member further having a flexible diaphragm connected to a peripheral flange that mounts onto the closure formed between the valve-bearing closure (mounting cup) and the bead of the aerosol container.

There are several critical seals between the valve-opening finger-bearing members that must be effected to achieve satisfactory performance of the metering actuator. There must be a seal, during actuation or downward movement of the valve stem to open the aerosol valve, between the respective members to close-off the metering chamber from the conduit terminating in the discharge nozzle. Secondly, there must be a seal at the interfit between the valve-opening member and the finger-bearing member.

The valve-opening member has a central hub defining a recess to receive the valve stem of a conventional aerosol valve, such as, described in the U.S. Pat. No. 2,631,814, issued Mar. 17, 1953 to Robert H. Abplanalp, which patent is incorporated by reference herein. The valve-opening member also has a conduit in open communication with the valve stem of the aerosol valve at one end and a metering chamber defined by the valve-opening and finger-bearing members at the other end.

The valve-opening member is surrounded by a finger-bearing member forming, together with the valve-opening member, an interior metering chamber. The finger-bearing members also have conduit connecting the metering chamber and a discharge nozzle. The respective members are so constructed that, when the finger-bearing member is pressed downwardly to open the valve of the container, the conduit leading to the discharge nozzle first continuing from the metering chamber and subsequently as the downward pressure opens the container valve the metering chamber, being in communication with the conduit in the valve stem, is filled with a predetermined quantity of the material to be dispensed. When finger pressure is released and the aerosol valve closed, the conduit leading to the discharge orifice is unsealed and the material within the metering chamber exhausted through the discharge orifice.

The accompanying drawing illustrates one practical embodiment of the invention, but the construction therein shown is to be understood to be illustrative only, and not as defining the limits of the invention.

FIG. 1 shows the aerosol valve in a closed position.

FIG. 2 shows the aerosol valve in an open position.

Figure 2:
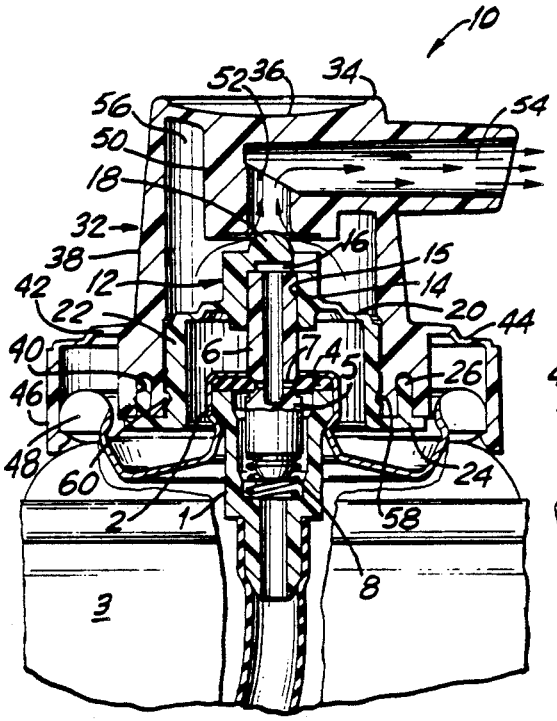
FIG. 2 is a vertical section as in FIG. 1.

The valve here shown has a valve body 1, secured within the valve housing 2 associated with a container indicated generally at 3. An annular sealing gasket 4 is clamped between the valve housing and valve body. A valve core 5 is positioned within the valve body and has an upstanding tubular valve stem 6 which extends through the opening in the gasket 4 and has one or more orifices 7 which are normally sealed by the gasket 4 when the parts are in the position shown in FIG. 1.

Downward pressure on the valve stem will move the valve stem and core into the position of FIG. 2. to unseal the orifice 7, so that aerosol material within the container 3 may flow through this orifice and through the hollow valve stem and out of the upper end of the latter. A spring 8 normally maintains the valve in the closed position of FIG. 1.

The present invention is directed, as hereinbefore stated, to an actuator of novel construction so constituted that it may effect the dispensing of measured quantitives of the aerosol material delivered through the valve stem.

Figure 1:
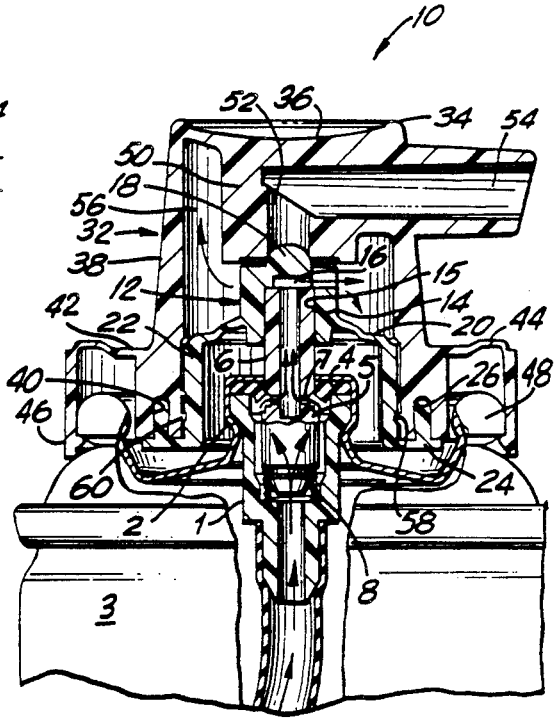
FIG. 1 is a vertical section through the actuator of the subject invention disposed on a valved aerosol container, the valve and container being shown in partial section.
Figure 5:
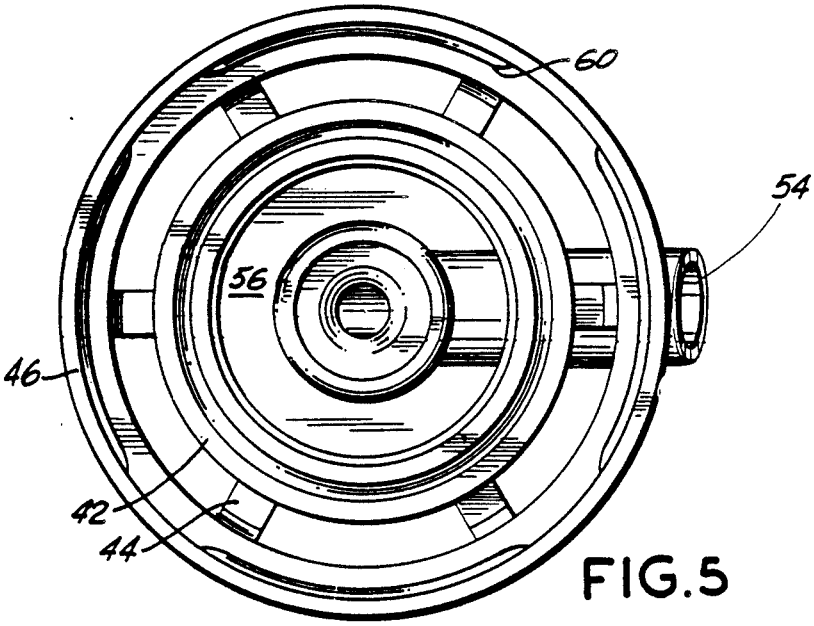
FIG. 5 is a plan view of the finger-bearing member of the actuator of this invention.

In FIGS. 1 and 2 of the drawing is shown the metering actuator of this invention, generally designated as 10. The valve opening member 12 is disposed on the valve stem 6. The valve-opening member 12 has a central hub portion 14 which defines a recess 15 for receiving the valve stem 6 in frictional engagement therewith. Extending from the recess 15 is a lateral conduit 16. Axially aligned with the recess 15 is a hemispherically-shaped dome portion 18. The hub 14 has a radially extending annular flange portion 20, which terminates in a side wall portion having at its terminus a lateral annular flange 24. Disposed outwardly from the side-wall portion 22 is an upstanding annular wall 26.

The finger-bearing member is generally designated at 32. The finger-bearing member has a top portion 34 with a saucer-like depression 36 to indicate the placement of the manual pressure. Extending downwardly from the top portion 34 is an annular side-wall 38; the side-wall extends from the top portion 34. The side-wall 38 has an annular recess 40 at its lower end, which recess, as will be more fully described hereafter, is constructed to receive the upstanding annular wall 26 in an interference fit relation thereby forming a seal between the annular wall 26 and the recess 40. An annular lateral flange 42 terminating in spaced flexible webs 44 extends from the side wall 38. An annualar side-wall 46 extends from the flexible webs 44, the side-wall 46 being constructed to snap-on the bead 48 of the container 3.

Depending from the underside of the top position 36 is a hub 50 defining a recess 52 for receiving the dome portion 18 of the valve-opening member, the recess 52 communicating with a lateral discharge nozzle 54. The hub 50 defining the recess 52 and the dome position 18 form a seal when the hub is advanced toward the dome portion.

The finger-bearing member 32 is constructed to fit onto and surround the outer surface of the side-wall 22. A metering chamber 56 is formed by the top portion 36, the side-wall 38 and the valve-opening member.

To effect a better seal between the valve-opening member 12 and the finger-bearing member 32, the side-walls 22 and 38 of the valve-opening member 12 and the finger-bearing member 32, respectively, may have mating recesses 58 and protuberances 60.

The normal relation of the parts is as shown in FIG. 1 from which it will be noted that the orifice 7 of the valve-stem 6 is closed and the container is thus sealed. When it is desired to dispense material from the aerosol container, downward pressure is applied to the top surface 36 of the finger-bearing member 32. As this pressure is applied the finger-bearing member, while held firmly on the bead of the container, is free to move toward the valve-opening member by the flexure of the flexible webs. This downward movement continues until there is an engagement between the dome portion of the valve-opening member and the hub defining the recess in the finger-bearing member. The engagement of the dome portion and the hub isolates the metering chamber from the discharge nozzle. The above-described relative movement between the finger-bearing member and the valve-opening member results because the resistance to flexing of the webs is less than the resistance of the valve stem to recede. Thus, during this initial movement to isolate the discharge nozzle from the metering chamber, no movement is imparted to the valve stem. However, continued downward pressure and consequent downward movement of the finger-bearing member will be imparted to the valve stem through the hub of the valve-opening member to the upper end of the valve stem with the result that said valve stem will be depressed into the position shown in FIG. 2, to establish communication between the interior of the container and the metering chamber. Material will then flow from the container until it fills the metering chamber and the hollow valve stem, after which such flow will cease.

When the pressure manually applied to the top of the finger-bearing member is released, the valve stem will return to the position shown in FIG. 1, that is, to a sealed position. Continued upward movement of the finger-bearing member will lift and separate the hub of the finger-bearing member from the dome portion of the valve-opening member. The separation of the hub and dome will open communication between the metering chamber and the discharge nozzle so that the measured quantity of the material from the aerosol container comprising the active ingredient and the propellant that have been trapped in the metering chamber and the valve stem will be autogenously exhausted through the discharge nozzle.

At the conclusion of the dispensing operation, the metering actuator and the aerosol valve will appear as shown in FIG. 1 with both the metering chamber and the passage to the valve stem ready for the next dispensing operation.

Figure 3:
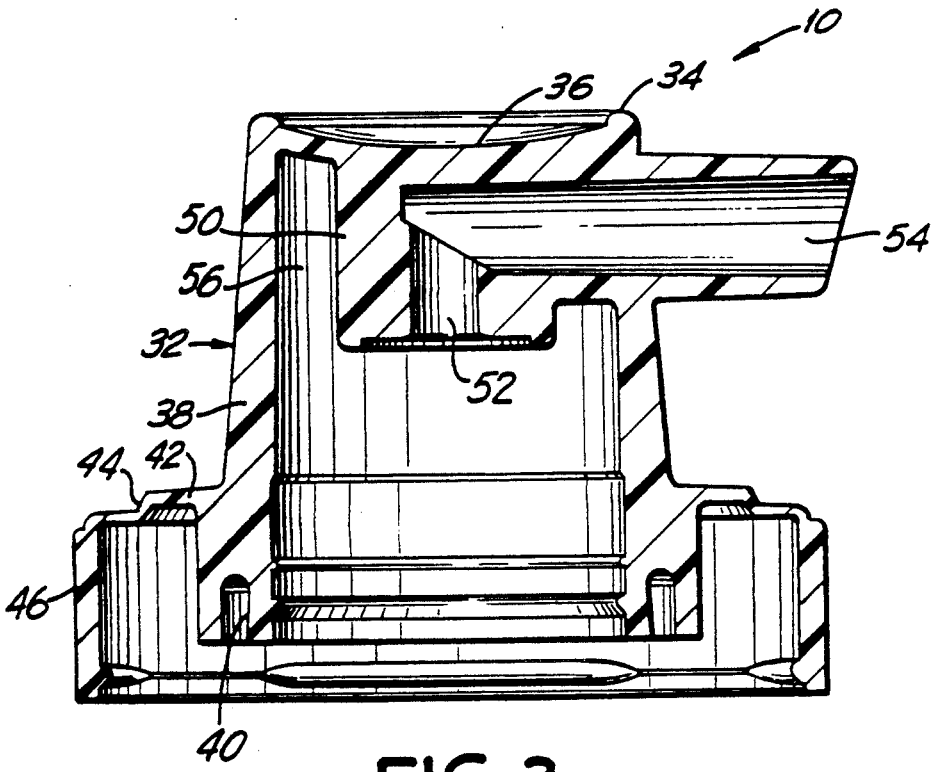
FIG. 3 is a vertical section through the finger-bearing member of the metering actuator of this invention.
Figure 4:
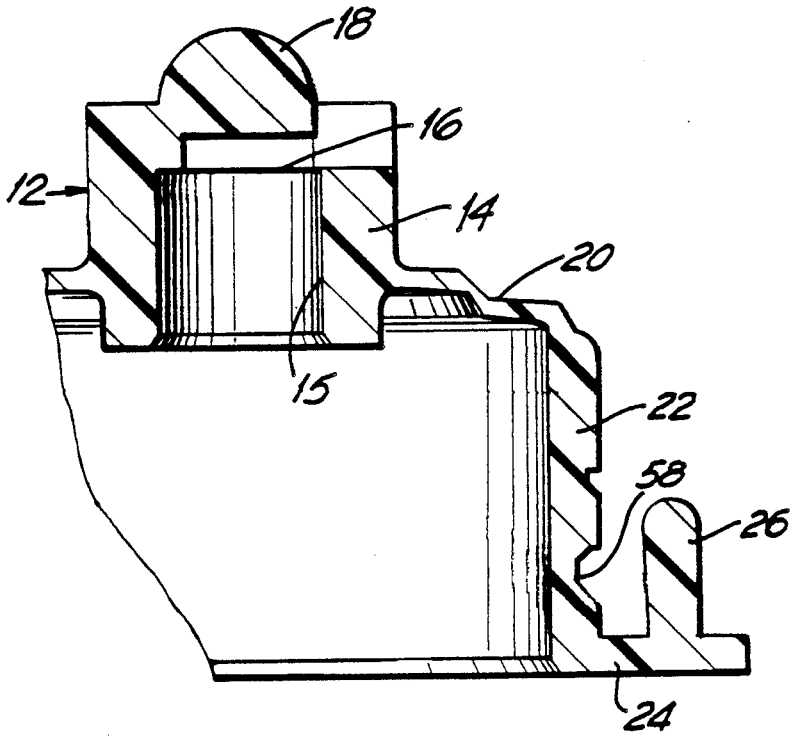
FIG. 4 is a partial vertical section through the valve-opening member of the metering actuator of this invention.

The improvement in sealing accomplished by the subject structure to isolate the metering chamber from the discharge nozzle and to effect the seal between the side-walls of the finger-bearing member and the valve-opening member is best shown in FIGS. 3 and 4.

Referring to the seal between the hub 50 of the finger-bearing member and the hemispherically shaped dome 18, it has been found desirable to radius the hub at the entry of the recess 52. The hemispherical dome is constructed such that recess 52 advances onto the dome 18 creating a plug-like seal between the dome 18 and the hub 50. A dome having a radius of 0.062" has been found satisfactory.

Referring to the seal between the side walls of the finger-bearing member 32 and the valve-opening member 12, it has been found than an annular upstanding annular wall 26 having a length of approximately 0.070" is satisfactory. Further, the upstanding wall 26 is preferably tapered outwardly from the base to the top of the wall; a three degree (3°) taper has been found satisfactory. The seal between the side walls of the finger bearing member and the valve-opening member is enhanced by the substantial surface contact between the upstanding annular wall 26 and the wall defining the recess 40. Moreover, the mating recesses or undercuts 58 and protuberances 60 in the respective outer surfaces of the walls 22 and 38, aid in the seal.

The actuator of the present invention may be efficiently and economically manufactured by the well known injection molding technique and the diaphragm and rigid superstructure of the button may be assembled simply and efficiently. The actuator may be molded from linear low density polyethylene.

What Is claimed

1. A metering actuator for dispensing the pressurized contents of an aerosol container through a tubular valve stem associated therewith comprising:

(a) a valve-opening member having a hub defining a recess suitable for receiving a valved, tubular valve stem, said hub having a conduit therethrough communicating at one end with the valve stem and at the other end with a metering chamber, said hub further having a dome portion, an annular lateral flange, an annular sidewall extending downwardly from the lateral flange, and sealing means associated with the annular side-wall;

(b) a finger-bearing member constructed so as to surround and seal with the valve-opening member, having a hub defining a recess suitable for receiving the dome portion of the valve-opening member in sealing relation, and said hub defining, at least in part, a conduit for the flow of material to a discharge nozzle, said finger-bearing member further having (i) an annular side-wall having sealing means associated therewith, (ii) a flexible flange extending laterally from the side wall, and (iii) a further annular sidewall extending downwardly from the flexible flange suitable for attaching the finger-bearing member to the valve closure bead of an aerosol container;

(c) the sealing means of the valve opening member and the finger bearing member forming an interference fit between an upstanding annular wall and a mating recess; and (d) a metering chamber defined by the undersurface of the finger-bearing member and the outersurface of the valve-opening member.

2. A metering actuator for dispensing the pressurized contents of an aerosol container through a tubular valve stem associated therewith comprising:

(a) a valve-opening member having a hub suitable for receiving a valved tubular valve stem, said hub having a conduit therethrough the tubular valve stem communicating at one end with the opening in the tubular valve stem and at the other end with a metering chamber, said hub further having a dome portion, a flange and an annular side-wall extending downwardly from the flange and terminating in a second flange extending from the side-wall, said second flange having an upstanding annular wall; and (b) a finger-bearing member surrounding and fitted to the valve-opening member, said finger bearing member having a hub defining a recess suitable for receiving in a sealing relation the dome portion of the valve-opening and defining at least in part, a conduit for the flow of material to a discharge nozzle; said finger-bearing member further having a side-wall having a recess for receiving and sealing with upstanding annular wall of the valve-opening member;

(c) a flexible flange extending outwardly from the sidewall of the finger-bearing member and terminating in a second side-wall suitable for attaching the finger-bearing member to the closure bead of an aerosol container; and (d) a metering chamber defined by the undersurface of the finger-bearing member and the outersurface of the valve-opening member.

3. The actuator of claim 1, and further wherein the outer surface of the dome portion is contoured such that the outer surface of the dome and hub of the finger-bearing member has a plug-like interference fit.

4. The metering actuator of claim 2, and further wherein the upstanding annular wall tapers outwardly from its base.

* * * * *

UNITED STATES PATENT AND TRADEMARK OFFICE

CERTIFICATE OF CORRECTION

PATENT NO. : 4,991,751

DATED : February 12, 1991

INVENTOR(S) : Naku, Virgil

It is certified that error appears in the above—identified patent and that said Letters Patent is hereby corrected as shown below:

In claim 2, column 6, line 10, add --member-- after valve opening.

Signed and Sealed this

Fourth Day of August, 1992

*Attest:*

DOUGLAS B. COMER

*Attesting Officer*

*Acting Commissioner of Patents and Trademarks*